US009113696B2

(12) United States Patent
Quartarone, III

(10) Patent No.: US 9,113,696 B2
(45) Date of Patent: Aug. 25, 2015

(54) BACKPACK SHOULDER STRAP

(75) Inventor: Frank Anthony Quartarone, III, Natick, MA (US)

(73) Assignee: Samsonite IP Holdings S.a r.l., Luxembourg (LU)

( * ) Notice: Subject to any disclaimer, the term of this patent is extended or adjusted under 35 U.S.C. 154(b) by 304 days.

(21) Appl. No.: 13/398,085

(22) Filed: Feb. 16, 2012

(65) Prior Publication Data

US 2012/0205409 A1 Aug. 16, 2012

Related U.S. Application Data

(60) Provisional application No. 61/443,541, filed on Feb. 16, 2011.

(51) Int. Cl.
*A45F 3/04* (2006.01)

(52) U.S. Cl.
CPC . *A45F 3/04* (2013.01); *A45F 3/047* (2013.01); *Y10T 29/49826* (2013.01)

(58) Field of Classification Search
CPC ..... A45F 3/04; A45F 3/042; A45F 3/047; A45F 3/06; A45F 3/08; A45F 2003/04; A45F 2003/146
See application file for complete search history.

(56) References Cited

U.S. PATENT DOCUMENTS

| | | | | |
|---|---|---|---|---|
| 4,087,031 | A * | 5/1978 | Fenner | 224/602 |
| 4,273,274 | A | 6/1981 | Freistadt | |
| 4,479,595 | A * | 10/1984 | Opsal | 224/630 |
| 4,563,777 | A | 1/1986 | Park | |
| 5,178,309 | A * | 1/1993 | Bicheler et al. | 224/153 |
| 5,181,638 | A * | 1/1993 | McHale | 224/637 |
| 5,240,159 | A * | 8/1993 | Gregory | 224/628 |
| 5,337,934 | A | 8/1994 | Johnson et al. | |
| 5,497,922 | A * | 3/1996 | Tate | 224/647 |
| 5,553,759 | A * | 9/1996 | McMaster et al. | 224/631 |
| 5,704,530 | A * | 1/1998 | Scherer | 224/632 |
| 5,743,448 | A | 4/1998 | Tsai | |
| 5,954,253 | A * | 9/1999 | Swetish | 224/631 |
| 5,961,019 | A * | 10/1999 | Gleason et al. | 224/643 |
| 6,070,776 | A * | 6/2000 | Furnary et al. | 224/627 |
| 6,164,509 | A | 12/2000 | Gausling et al. | |
| 6,257,472 | B1 | 7/2001 | Freedman | |
| 6,394,328 | B1 | 5/2002 | Zakarin | |
| 6,626,342 | B1 * | 9/2003 | Gleason | 224/633 |
| 6,802,442 | B1 * | 10/2004 | Thompson | 224/637 |
| RE39,853 | E | 9/2007 | Fier | |
| 7,422,131 | B2 | 9/2008 | Cohen | |
| D614,400 | S | 4/2010 | Simonian et al. | |
| 2005/0061844 | A1 * | 3/2005 | Haro | 224/639 |
| 2005/0199658 | A1 | 9/2005 | Brown et al. | |
| 2006/0032883 | A1 | 2/2006 | Moreno et al. | |

(Continued)

FOREIGN PATENT DOCUMENTS

| | | | |
|---|---|---|---|
| CA | 2186048 | A1 | 3/1998 |
| JP | 2001245720 | A | 9/2001 |
| JP | 2006326250 | A | 12/2006 |

*Primary Examiner* — Brian D Nash
(74) *Attorney, Agent, or Firm* — Dorsey & Whitney LLP

(57) ABSTRACT

A backpack may include a main body that defines a main compartment that may be accessed by a sealing mechanism. The backpack may also include a shoulder strap that is coupled to a first portion of the main body and coupled to a second portion of the main body, with the second portion of the main body distal the first portion. The backpack may also include a secondary support strap coupled to the shoulder strap and the first portion of the main body.

27 Claims, 10 Drawing Sheets

(56) References Cited

U.S. PATENT DOCUMENTS

2006/0289586 A1* 12/2006 Gregory ..... 224/627
2009/0026241 A1* 1/2009 Leyendecker ..... 224/637
2009/0084821 A1* 4/2009 Lenzi ..... 224/155
2009/0206118 A1* 8/2009 Sabbah ..... 224/652
2010/0108730 A1* 5/2010 Sabbah ..... 224/651
2012/0024926 A1* 2/2012 Ghassemi ..... 224/628

* cited by examiner

BACKPACK SHOULDER STRAP

CROSS-REFERENCE TO RELATED APPLICATION

This application claims the benefit, under 35 U.S.C. §119 (e), of U.S. provisional application No. 61/443,541, entitled "Backpack Shoulder Strap" and filed on Feb. 16, 2011, which is hereby incorporated in its entirety by reference herein.

FIELD OF INVENTION

The field of invention generally relates to apparatuses for carrying items, and more particularly to backpacks.

BACKGROUND

Backpacks are often used to carry various objects in a convenient manner. Oftentimes the objects may be heavy, such as textbooks or notebooks. The weight of the backpack and its contents is usually distributed through one or two shoulder straps; in the case of two straps, one for each shoulder of the person carrying the backpack. Wide shoulder straps help distribute the weight over the surface area of the carrier's shoulders, but may impede airflow to the shoulders.

SUMMARY OF THE INVENTION

One embodiment of a backpack may include a main body that defines a main compartment. The main compartment may be accessed by a sealing mechanism. The backpack may include a shoulder strap. The shoulder strap may be coupled to a first portion of the main body and coupled to a second portion of the main body. The second portion of the main body may be distal the first portion. The backpack may also include a secondary support strap coupled to the shoulder strap and the first portion of the main body.

One embodiment of constructing a backpack may include coupling a backpack shoulder strap to a main body of the backpack. The shoulder strap may include a tapered portion proximate where the shoulder strap is coupled to the main body. The method may also include coupling a secondary support strap proximate the tapered portion of the shoulder strap. The method may further include coupling the secondary support strap to the main body of the backpack.

DETAILED DESCRIPTION

Described herein is a backpack with at least one shoulder strap and one secondary support strap. The backpack may include one or more compartments. Each compartment may include at least one zipper or other sealing mechanism (such as velcro). The backpack may also include other features such as side pockets, a compression mechanism, a top handle, a laptop compartment, a cell phone holder, a water bottle holder, and so forth. The rear of the backpack may be padded for comfort. A user may carry the backpack by suspending one or more shoulder straps on his or her shoulders. Each shoulder strap may be positioned at the rear of the backpack and coupled at an upper portion of a main body of the backpack. Each shoulder strap may be tapered proximate the upper portion. Such tapering allows a relatively large surface area to contact the person's shoulder (the compression area) while minimizing the width of the shoulder strap that is coupled to the upper portion of the main body. Each shoulder strap may be supported by a secondary support strap that is coupled to, or defined by, the shoulder strap. The secondary support strap may be coupled to the upper portion of the main body. Each shoulder strap may be coupled to either a lower portion or side panel of the main body. In some embodiments, the shoulder strap may be coupled to the lower portion or side panel of the main body through an adjustment device, such as an adjustment strap or the like. In some embodiments, the secondary support strap or secondary support straps may be adjustable.

Figure 1:
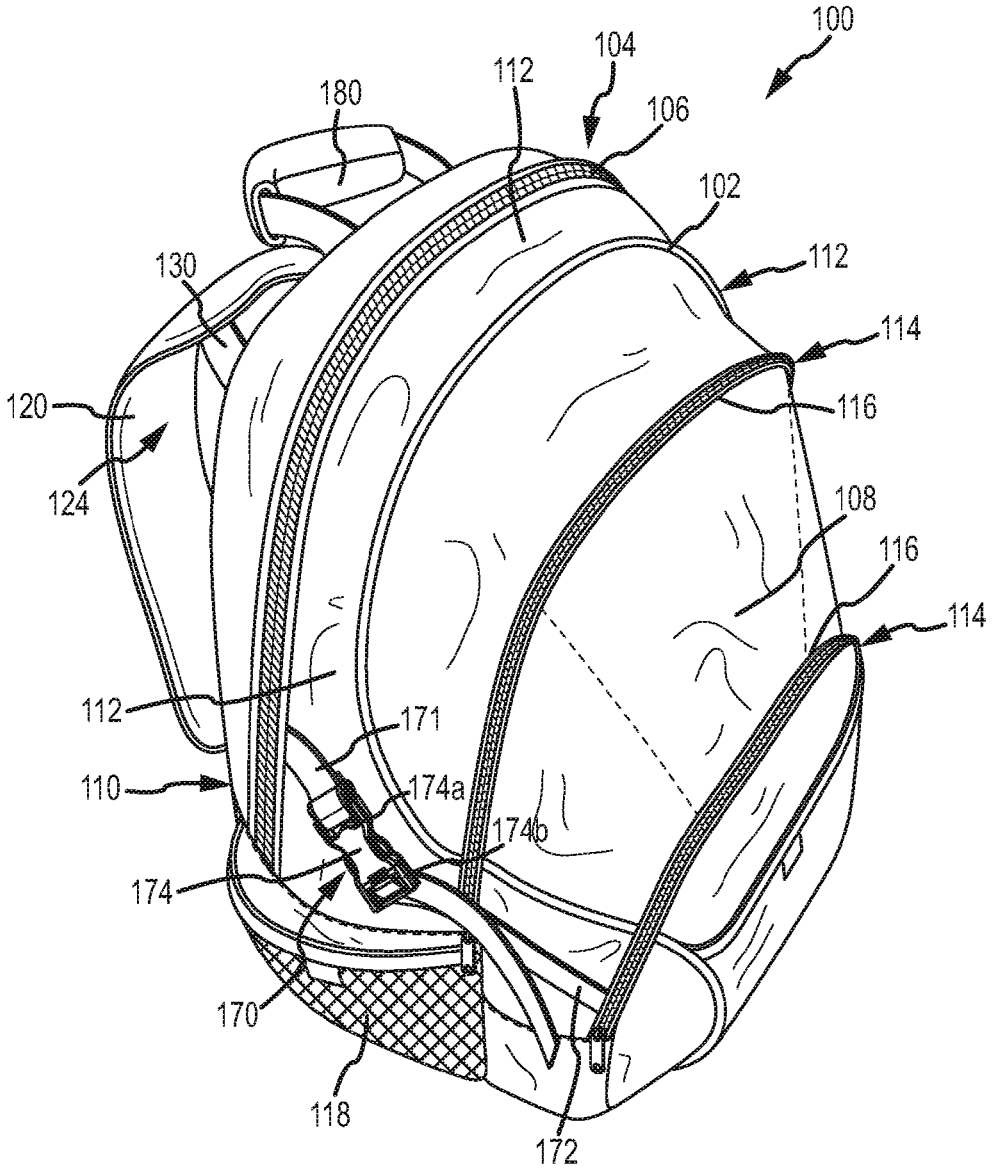
FIG. 1 shows a front perspective view of an embodiment of a backpack that incorporates a secondary support strap for a shoulder strap.

FIG. 1 shows a front perspective view of a backpack 100 with two shoulder straps 120 (only one shoulder strap 120 and its secondary support strap 130 are visible in FIG. 1). With reference to FIG. 1, the backpack 100 may include a main body 102. The main body may define a main compartment 104 that can be opened or closed with a main zipper 106, a pair of main zippers, or any other sealing mechanism 106 (such as velcro). Front 108, rear 110, and side panels 112 may define the main body 102. The backpack 100 may also include one or more accessory compartments 114 that are defined by the main body 102 and/or coupled to the main body 102. Each accessory compartment 114 may be accessed by opening and closing one or more secondary zippers or other sealing mechanisms. The backpack 100 may also include one or more side pockets 118 for additional storage. The side pockets 118 may be defined by the main body 102 and/or coupled to the main body 102. The side pockets 118 may be formed of a mesh material, or may be formed from material similar to the material used to form the main body 102 of the backpack 100. The side pockets 118 may either be accessed via a sealing mechanism, such as a zipper (not specifically shown in FIG. 1), or may include an opening that cannot be selectively opened and closed.

In some embodiments, the backpack 100 may have compression mechanisms 170 on the left 112 and right 112 sides of the backpack 100 that allow the user to selectively compress the backpack 100 when the compartments 104, 114 are not full. The compression mechanisms 170 may also provide support to the sides 112 of the backpack 100 when the compartments 104, 114 are full. Each compression mechanism 170 may be configured as two straps 171, 172. Each strap 171, 172 may be coupled to a buckle element 174 on one end and be coupled to the main body 102 on the other end. For example, a first strap 171 may be coupled to a side panel 112 of the main body 102 and a first buckle element 174*a*. A second strap 172 may be coupled to the front panel 108 of the main body 102 and a second buckle element 174*b*. The second buckle element 174*b* may be selectively coupled to the first buckle element 174*a* to couple the first strap 171 to the second strap 172. One or both of the buckle elements 174 may allow the strap 172 to be adjusted, thereby allowing a user to selectively compress or decompress one or more of the main body's 102 compartments 104, 114 by selectively shortening or lengthening the distance between the area of the main body 102 to which the strap 172 is coupled and the respective buckle element 174 of the strap 172. The straps 171, 172 of the compression mechanism 170 may be coupled to the main body 102 in other areas as well. For example, one strap 171 could be coupled to the seam between the rear 110 and side panels 112 of the main body 102, with the other strap 172 coupled to a side panel 112 of an accessory compartment 114. Also, the straps 171, 172 may be coupled by something other than a buckle element 174, such as a slider element (not specifically shown in FIG. 1). The foregoing examples are merely illustrative of some ways to form and/or couple a compression mechanism 170 for a backpack 100 and are not intended to be limiting. As such, the backpack 100 may use any suitable compression mechanism 170 that allows a user to selectively compress and decompress the backpack 100. In some embodiments, the backpack 100 may have more than one compression mechanism 170 on each side 112 of the main body 102, or no compression mechanisms at all.

The backpack 100 may also include a top handle 180 that allows the backpack 100 to be lifted, as shown in FIG. 1. The top handle 180 may be coupled to the main body 102 at the seam between the rear panel 110 and the upper portion of the main body 102, or at any other suitable location. In some embodiments, the top handle 180 may be coupled to the main body 102 at the same location as the shoulder straps 120. In some embodiments, the backpack 100 may include a side handle that is coupled to the main body 102 at the seam between the rear panel 110 and the side panel 112 of the main body 102, or at any other suitable location (not specifically shown in FIG. 1).

Figure 2:
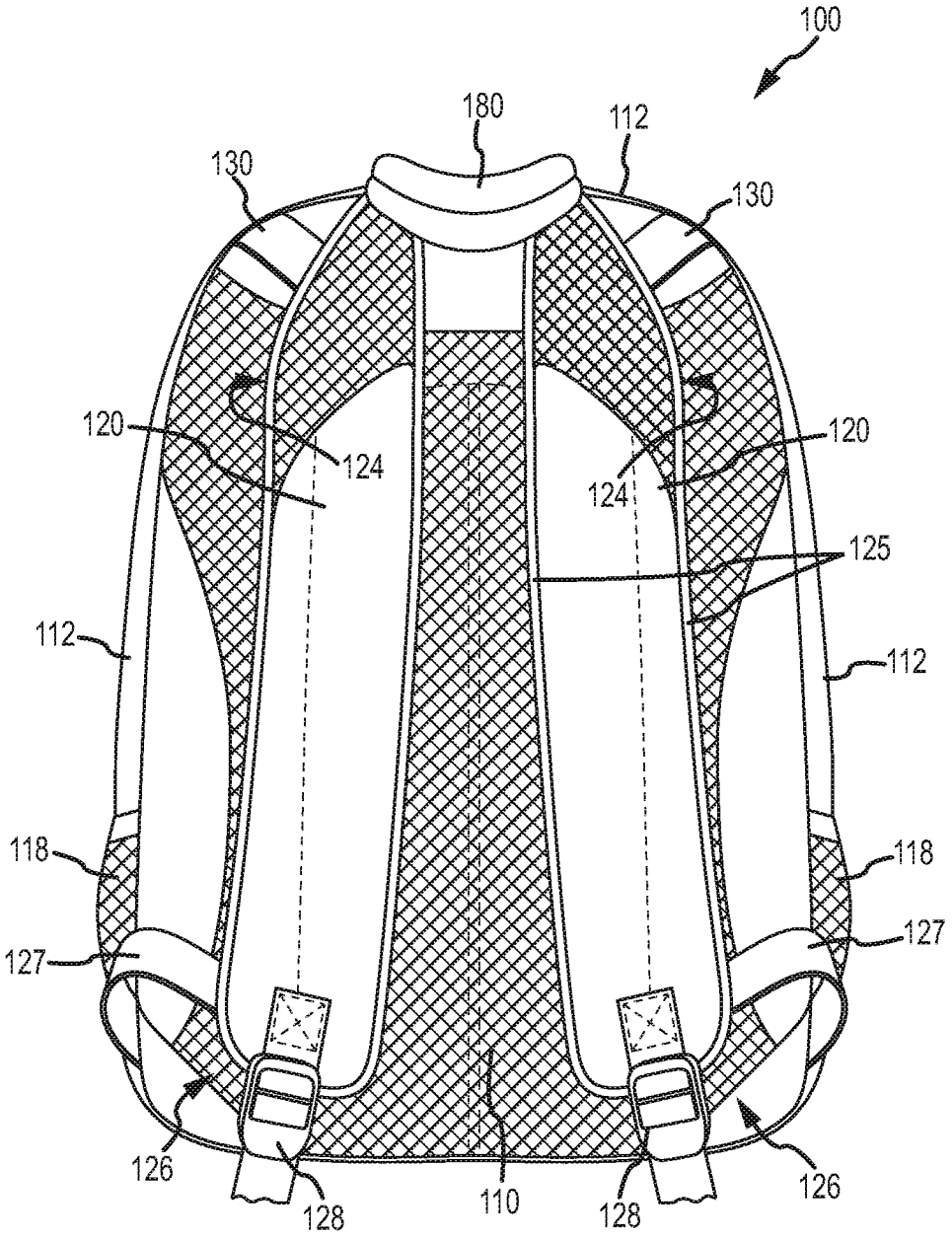
FIG. 2 shows a rear perspective view of the backpack shown in FIG. 1.

The backpack 100 may further include one or more shoulder straps 120. A secondary support strap 130 may be coupled to each shoulder strap 120. In some embodiments, the backpack 100 may have only one shoulder strap 120 with a secondary support strap 130. With reference to FIGS. 1 and 2, a first shoulder strap 120 (for convenience, only the right shoulder strap 120 will be described, as a left shoulder strap 120 is similar to the right shoulder strap 120) may be positioned at the rear of the backpack 100 and coupled to the upper portion of a main body 102. The shoulder strap 120 may be coupled to the main body 102 by any suitable coupling method, including, but not limited to, by sewing, bonding, adhering, snapping, thermal welding, and so on.

Figure 3:
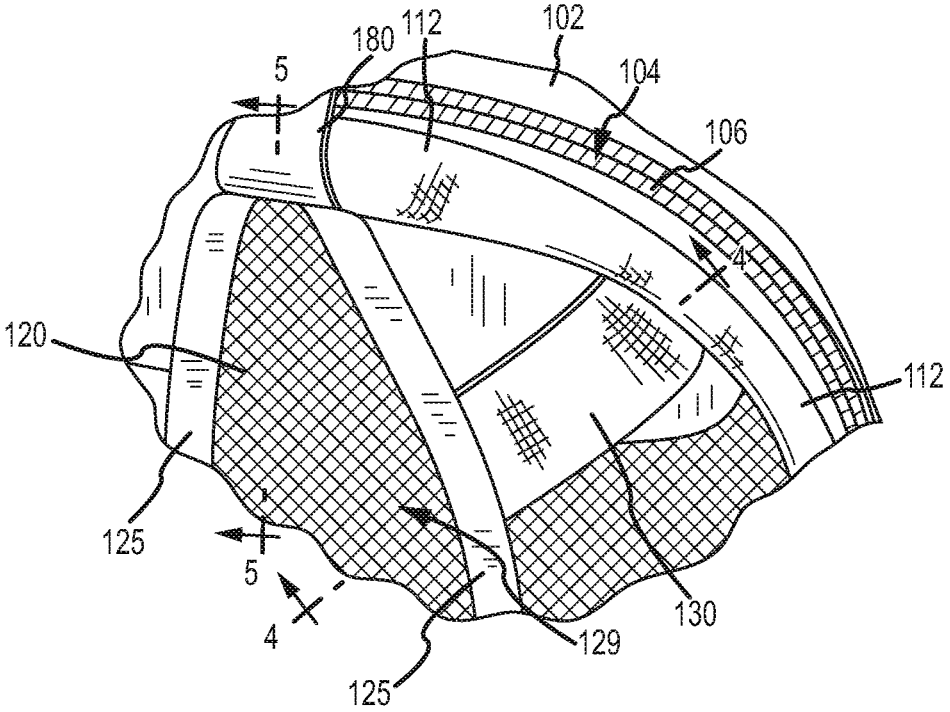
FIG. 3 shows an enlarged view of the right shoulder strap of the backpack shown in FIG. 1 and its secondary support strap.
Figure 5:
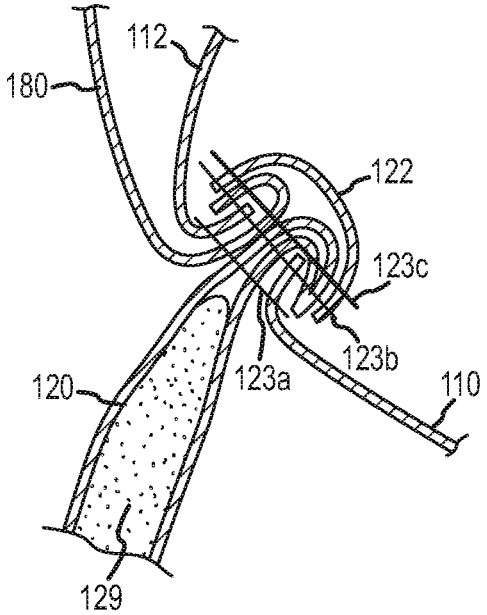
FIG. 5 shows a cross section view of the right shoulder strap of the backpack shown in FIG. 1 viewed along line 5-5 of FIG. 3.

In some embodiments, and as shown in FIGS. 3 and 5, the shoulder strap 120 and the top handle 180 may be coupled to the main body 102. A portion of the shoulder strap 120 and a portion of the top handle 180 may be positioned between the rear panel 110 and the upper side panel 112 of the main body 102 before the rear panel 110 and upper side panel 112 of the main body 102 are coupled together (e.g., by sewing) to form, among other things, the main compartment 104. With a portion of the shoulder strap 120 and a portion of the handle 180 between the panels 110, 112, the panels 110, 112 may be coupled together (e.g., by sewing) along a seam 123*a*. A second portion of the shoulder strap 120 and a second portion of the handle 180 may extend beyond the rear panel 110 and upper side panel 112 into the main body 102 and/or the main compartment 104 of the backpack 100. The second portion of the shoulder strap 120 may then be wrapped around the rear panel 110, and the second portion of the top handle 180 may be wrapped around the upper side panel 112. A sheath 122 may be used to cover the shoulder strap 120, the handle 180, the rear panel 110, and the upper side panel 112. When a sheath 122 is used, as shown in FIG. 5, a seam 123*b* may be sewn through the sheath 122, the top handle 180, the upper side panel 112, the top handle 180 again, the shoulder strap 120, the rear panel 110, the shoulder strap 120 again, and finally through the sheath 122 again. In other embodiments, another type of coupling element (e.g., snap, adhesive, etc) may couple the parts together. In some embodiments, a reinforcement seam 123*c* may be sewn, as shown in FIG. 5, which may or may not pass through all of the layers of material. The foregoing example is merely illustrative of one way to couple a shoulder strap 120 and top handle 180 to a main body 102 of a backpack 100 and is not intended to be limiting. As such, the shoulder strap 120 and top handle 180 may be coupled to the main body 102 of the backpack 100 in any suitable manner, including embodiments where they are not coupled to the main body 102 along a shared seam.

With reference to FIGS. 2 and 3, the shoulder strap 120 may increase in width as it approaches a compression area 124 (i.e. the area where the shoulder strap rests on the user's shoulder when the backpack is on his or her back) so that the shoulder strap 120 has more surface area over which to spread the weight of the backpack 100 on the user's shoulder. A second or left shoulder strap 120 (not shown in FIG. 1) similarly may be coupled to the upper portion of the main body 102 and may similarly increase in width as it approaches a similar compression area 124. Each of the one or more shoulder straps 120 may be formed using the same material as the main body 102 of the backpack 100, such as nylon, or may be formed using a cushioning material 129. If a cushioning material 129 is used, such as foam, the cushioning material 129 may be enclosed by an outer shell of material, such as nylon. Additionally, a layer of mesh-like material may be added on top of, or used in place of, the outer shell in order to improve breathability of the shoulder strap 120. In some embodiments, one or more sheaths 125 may be wrapped around portions of the shoulder strap 120 to improve the durability of the shoulder strap 120 along its edges and/or to provide a desired shape to the edge. For example, a sheath 125 may be wrapped around the edge portions of the shoulder strap 120, as shown in FIG. 2. There are many other suitable ways of forming the shoulder straps 120, and the foregoing embodiments are merely illustrative of several ways to form a shoulder strap 120 and are not intended to be limiting.

Each shoulder strap 120 may be supported by a secondary support strap 130 that is coupled to the shoulder strap 120. The secondary support strap 130 may be coupled to the shoulder strap 120 by any suitable coupling method, including, but not limited to, by sewing, bonding, adhering, snapping, thermal welding, and so on. The secondary support strap 130 may also be coupled to the upper portion of the main body 102. The secondary support strap 130 may be coupled to the main body 102 by any suitable coupling method. In other embodiments, the secondary support strap 130 may be defined by the shoulder strap 120, and/or by the main body 102. For example, the secondary support strap 130 may be defined by the shoulder strap 120 and/or the main body 102 if it is an integral part of the shoulder strap 120 and/or the main body 102 in that the secondary support strap 130 is made from a common piece of material as the shoulder strap 120 and/or the main body 102.

With reference to FIG. 2, the lower portion of each shoulder strap 120 may be coupled to either a lower portion or side portion of the main body 102. In some embodiments, the lower portion of a first shoulder strap 120 (for convenience, a right shoulder strap 120 will be described, as a left shoulder strap 120 is similar) may be coupled to the main body 102 of the backpack 100 through an adjustment device 126. The adjustment device 126 may include a lower adjustment strap 127 and a slider mechanism 128, as shown in FIG. 2. The lower adjustment strap 127 may be coupled to the main body 102 in any suitable location, such as the seam between the rear panel 110 and the side panel 112 of the main body 102, and may be coupled by any suitable coupling method, including, but not limited to, by sewing, bonding, adhering, snapping, thermal welding, and so on. The lower adjustment strap 127 may be coupled to the main body 102 in other locations as well, such as the lower portion of the main body 102. The end of the lower adjustment strap 127 that is not coupled to the main body 102 may be slidably coupled to a slider mechanism 128 that is mounted on the lower portion of the shoulder strap 120. By sliding the lower adjustment strap 127 through the slider mechanism 128, a user may adjust the position of the adjustment strap 127 where the slider mechanism 128 engages when the backpack 100 is worn, thereby allowing the user to selectively adjust the location of the backpack 100 relative to the user's back when wearing the backpack 100. For example, by sliding the adjustment strap 127 through the slider mechanism 128 so that more of the adjustment strap 127 is between the shoulder strap 120 and the main body 102, the compression area 124 shifts towards the lower portion of the shoulder strap 120, thus causing the backpack 100 to sit lower on the person's back. Conversely, if the adjustment strap 127 is slid through the slider mechanism 128 so that less of the adjustment strap 127 is between the shoulder strap 120 and the main body 102, the compression area 124 will move towards the upper portion of the shoulder strap 120, thus causing the backpack 100 to sit higher on the person's back. In embodiments with two shoulder straps 120, the lower portion of the second (left) shoulder strap 120 may similarly be coupled to or coupled to the main body 102 of the backpack 100.

The lower portion of the shoulder straps 120 may be coupled to the main body 102 in other ways, as well, such as through buckle elements 174, or being directly coupled to the main body 102 by sewing, snaps, thermal welding, or any other suitable coupling method.

As described above, FIG. 2 shows the upper portion of each shoulder strap 120 tapering as it approaches the upper portion of the main body 102 from the lower portion. FIG. 2 also shows a secondary support strap 130 coupled to each shoulder strap 120 and to the main body 102 of the backpack 100. In some embodiments, as shown in FIG. 2, the rear panel 110 of the main body 102 may in some embodiments be made of or supplemented with a cushioning material to increase comfort for the person wearing the backpack 100. A mesh-like material may cover the cushioning to improve breathability.

FIG. 3 shows an enlarged view of the upper portion of a shoulder strap 120 and a secondary support strap 130 of the backpack 100 shown in FIGS. 1 and 2. As described above, the shoulder strap 120 may be positioned at the rear of the backpack 100 and coupled to the upper portion of the main body 102. The upper end portion of the shoulder strap 120 may be coupled to the main body 102 of the backpack 100 by, for example, coupling the shoulder strap 120 along the seam between the rear panel 110 of the main body 102 and the upper side panel 112 of the main body 102. In some embodiments, this may be accomplished by placing the upper end portion of the shoulder strap 120 between the rear panel 110 and the upper side panel 112 of the main body 102 before the rear panel 110 and upper side panel 112 are coupled (e.g., by sewing) together to form the main body 102, and then coupling (e.g., sewing) the panels 110, 112 together with the shoulder strap 120 between them. This allows for coupling (e.g., sewing) along a common seam or seam with, for example, a common stitch line or lines. The shoulder strap 120 shown in FIG. 3 may similarly be coupled to the main body 102 of the backpack 100 by any suitable coupling method.

Figure 4:
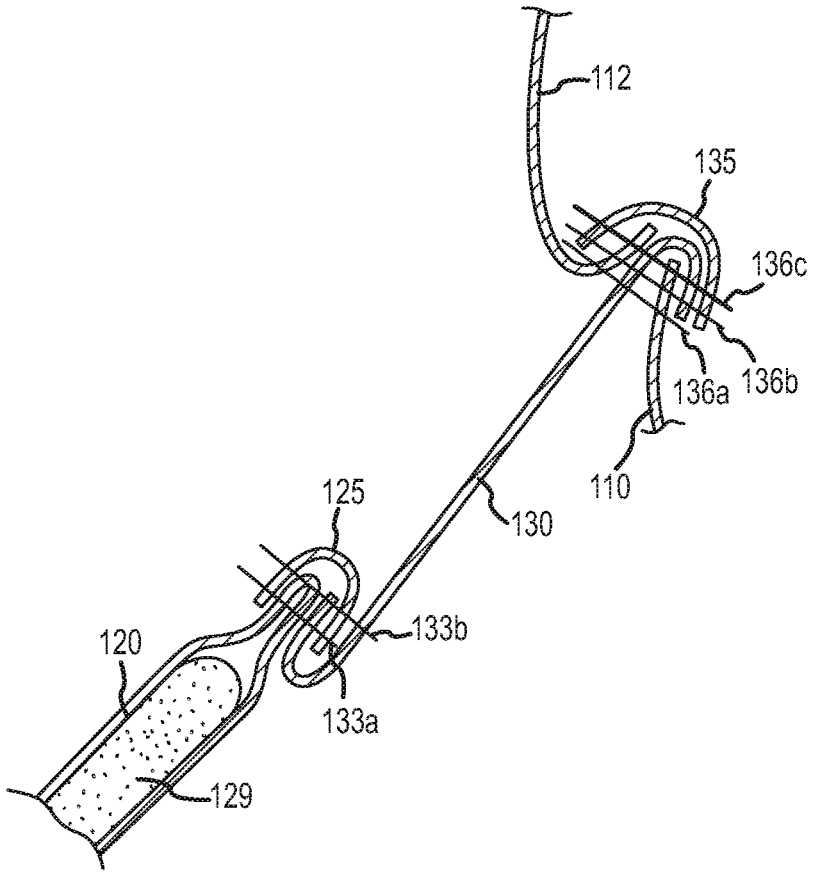
FIG. 4 shows a cross section view of the right shoulder strap of the backpack shown in FIG. 1 and its secondary support strap, viewed along line 4-4 of FIG. 3.

FIGS. 3 and 4 show one example of how the secondary support strap 130 may be coupled to the shoulder strap 120 and to the main body 102 of the backpack 100. With reference to FIG. 4, which is a cross section view of the shoulder strap 120 and its secondary support strap 130, viewed along line 4-4 of FIG. 3, the secondary support strap 130 may be coupled to the shoulder strap 120 by, for example, sewing the secondary support strap 130 to the back of the shoulder strap 120 (i.e. the side of the shoulder strap 120 closest to the main body 102 of the backpack 100). As described above, in some embodiments, a sheath 125 may be used to improve the durability of the shoulder strap 120 along its edges and/or to provide a desired shape to the edge. As shown in FIG. 4, the secondary support strap 130 may be aligned with the shoulder strap 120 in a first region, and the sheath 125 wrapped around the aligned end portions of the shoulder strap 120 and the secondary support strap 130. A first seam 133*a* may be sewn through the sheath 125, the shoulder strap 120, the secondary support strap 130, and finally again through the sheath 125. Of course other coupling methods may be used in addition to or in place of sewing seams. The secondary support strap 130 may then be wrapped around the edge of the sheath 125 (away from the shoulder strap 120), and a second seam 133*b* sewn through the sheath 125, the shoulder strap 120, the secondary support strap 130, the sheath 125 again, and then finally the secondary support strap 130 again. The foregoing example is merely illustrative of one way to couple a secondary support strap 130 to a shoulder strap 120 and is not intended to be limiting. As such, the secondary support strap 130 may be coupled to the shoulder strap 120 in any suitable manner.

The other end of the secondary support strap 130 (i.e. the end that is not coupled to the shoulder strap 120) may be coupled to the main body 102 of the backpack 100 by, for example, coupling the secondary support strap 130 along the seam between the rear panel 110 of the main body 102 and either the upper side panel 112 of the main body 102 or the side panel 112 of the main body 102. In some embodiments, and as shown, for example, in FIG. 4, this may be accomplished by placing the secondary support strap 130 between the rear panel 110 and the side panel 112 of the main body 102 before the rear panel 110 and side panel 112 are coupled together to form, among other things, the main compartment 104, and then coupling the panels 110, 112 together along a seam 136*a* with the secondary support strap 130 between them and the secondary support strap 130 extending beyond the rear panel 110 and the side panel 112 into the main body 102 and/or the main compartment 104 of the backpack 100. The excess secondary support strap 130 may then be wrapped around the end portion of the rear panel 110. A sheath 135 may also be used to cover the end portions of the two panels 110, 112 and the excess portion of the secondary support strap 130. When a sheath 135 is used, as shown in FIG. 4, a seam 136*b* may be sewn through the sheath 135, the upper portion or side panel 112, the secondary support strap 130, the rear panel 110, the secondary support strap 130 again, and finally through the sheath 135 again. In some embodiments, a reinforcement seam 136*c* may be sewn, as shown in FIG. 4 which may or may not pass through all the layers of material. Of course other coupling methods may also be used in addition to or in place of sewing. The foregoing example is merely illustrative of one way to couple a secondary support strap 130 to a main body 102 of a backpack 100 and is not intended to be limiting. As such, the secondary support strap 130 may be coupled to the main body 102 in any suitable manner.

As shown in FIGS. 2, 3, and 4, the shoulder strap 120 and the secondary support strap 130 may be configured so that they form a "Y" shape. In particular, the lower portion of the shoulder strap 120 forms the base of the "Y", while the upper, tapered portion of the shoulder strap 120 and the secondary support strap 130 form the two diverging branches of the "Y." The "Y" shape may provide several benefits. First, it may allow a relatively large surface area of the shoulder strap 120 (i.e. the compression area 124) to contact a user's shoulders, while reducing the width of the shoulder strap 120 that is coupled to the upper portion of the main body 102. Without the secondary support strap 130, a narrower shoulder strap 120 may decrease the load that can be transferred to the shoulder strap 120 from the main body 102 due to the decreased width of the joint where the shoulder strap 120 is coupled to the main body 102 as compared with a shoulder strap 120 that is not as narrow. The secondary support strap 130, however, may increase the load that can be transferred to the shoulder strap 120 from the main body 102 because the load from the main body 102 is transferred via the secondary support strap 130 in addition to the shoulder strap 120. Another potential advantage of the "Y" shape is that it provides increased breathability near the compression area 124.

Although not shown in FIGS. 3 and 4, a second secondary support strap 130 (left side) may be configured similar to the first (right side) secondary support strap 130 as described in detail above.

With reference to FIG. 5, and as described above, a shoulder strap 120 and a top handle 180 may be coupled to the main body 102. A portion of the shoulder strap 120 and a portion of the top handle 180 may be positioned between the rear panel 110 and the upper side panel 112 of the main body 102 before the rear panel 110 and upper side panel 112 of the main body 102 are coupled together (e.g., by sewing) to form, among other things, the main compartment 104. With a portion of the shoulder strap 120 and a portion of the handle 180 between the panels 110, 112, the panels 110, 112 may be coupled together (e.g., by sewing) along a seam 123*a*. A second portion of the shoulder strap 120 and a second portion of the handle 180 may extend beyond the rear panel 110 and upper side panel 112 into the main body 102 and/or the main compartment 104 of the backpack 100. The second portion of the shoulder strap 120 may then be wrapped around the rear panel 110, and the second portion of the top handle 180 may be wrapped around the upper side panel 112. A sheath 122 may be used to cover the shoulder strap 120, the handle 180, the rear panel 110, and the upper side panel 112. When a sheath 122 is used, as shown in FIG. 5, a seam 123*b* may be sewn through the sheath 122, the top handle 180, the upper side panel 112, the top handle 180 again, the shoulder strap 120, the rear panel 110, the shoulder strap 120 again, and finally through the sheath 122 again. Of course other coupling methods may also be used to couple the parts together. In some embodiments, a reinforcement seam 123*c* may be sewn, as shown in FIG. 5, which may or may not pass through all of the layers of material. The foregoing example is merely illustrative of one way to couple a shoulder strap 120 and top handle 180 to a main body 102 of a backpack 100 and is not intended to be limiting. As such, the shoulder strap 120 and top handle 180 may be coupled to the main body 102 of the backpack 100 in any suitable manner, including embodiments where they are not coupled to the main body 102 along a common seam.

Figure 6:
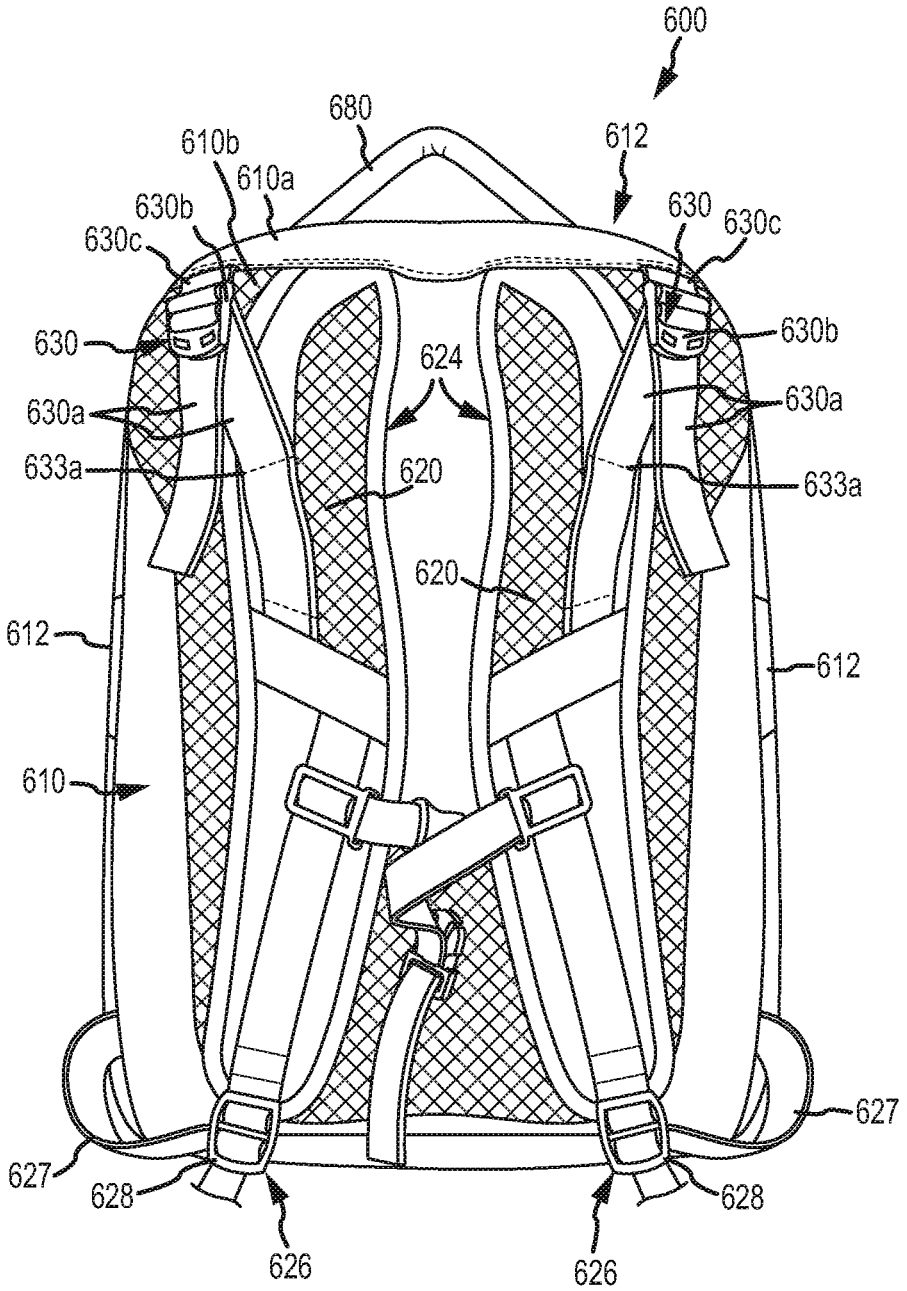
FIG. 6 shows a rear perspective view of a backpack that is similar to the backpack shown in FIG. 1.

With reference now to FIG. 6, another embodiment of a backpack 600 may be similar to the backpack 100 shown in FIGS. 1 through 5, and may further include one or more secondary support straps 630 that are adjustable. The backpack 600 may include a main body 602 that defines a main compartment 604. The main compartment may be selectively sealable by a main zipper 606 or other sealing mechanism. Front 608, rear 610, and side 612 panels may define the main body 602. With reference to FIG. 6, the rear panel 610 may include both an upper portion 610*a* and a lower portion 610*b* in some embodiments, whereas in other embodiments the rear panel 610 may not include separate upper and lower portions. Similar to the backpack 100 shown in FIG. 1, the backpack 600 shown in FIG. 6 may include accessory compartments, side pockets, a top handle 680, a side handle, a compression mechanism, an adjustment device 626 (possibly with an adjustment strap 627 and an adjustment slider 628), and so forth. In general, the backpack 600 may include none, one, or a plurality of each of these and other elements.

The backpack 600 may include one or more shoulder straps 620. A secondary support strap 630 may be coupled to each shoulder strap 620. In some embodiments, the backpack 600 may have only one shoulder strap 620 with a secondary support strap 630, whereas in other embodiments the backpack 600 may include two shoulder straps 620, each with a respectively secondary support strap 630. With reference to FIG. 6, a first shoulder strap 620 (for convenience, only the right shoulder strap 620 will be described, as a left shoulder strap 620 is similar to the right shoulder strap 620) may be positioned at the rear of the backpack 600 and coupled to the rear panel 610. The shoulder strap 620 may be coupled to the rear panel 610 by any suitable coupling method, including, but not limited to, by sewing, bonding, adhering, snapping, thermal welding, and so on.

Figure 8:
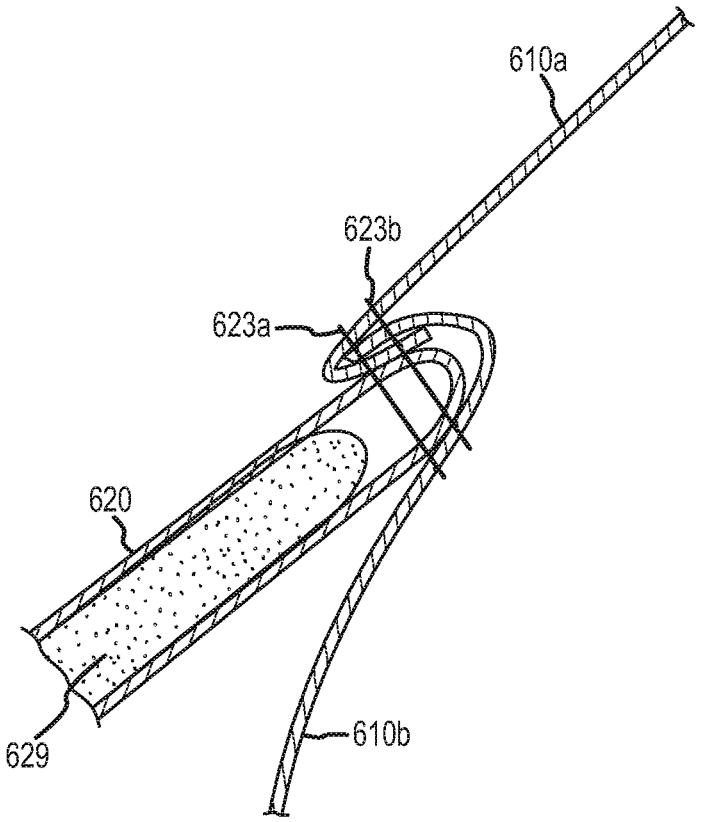
FIG. 8 shows a cross section view of the right shoulder strap of the backpack shown in FIG. 6, viewed along line 8-8 of FIG. 7.

In some embodiments, and with reference to FIGS. 6 and 8, the shoulder strap 620 may be coupled to the rear panel 610 in between the upper portion 610*a* of the rear panel 610 and the lower portion 610*b* of the rear panel 610. For example, the upper portion 610*a* of the rear panel 610 may be positioned along the shoulder strap 620, and the lower portion 610*b* of the rear panel 610 may be wrapped around the shoulder strap 620 and the upper portion 610*a* of the rear panel 610. The upper and lower portions 610*a*, 610*b* of the rear panel 610 may then be coupled along one or more seams 623*a*, 623*b* (one of which may be a reinforcement seam 623*b*). The seams 623*a*, 623*b* may be made, for example, by sewing a stitch, or by another coupling method. In some embodiments, a sheath (not specifically shown in FIG. 8) may be used, whereas in other embodiments, no sheath may be used. No sheath may be used, for example, if the lower portion 610*b* of the rear panel 610 sufficiently covers the seams 623*a*, 623*b*. In general, there are many suitable ways of coupling the shoulder strap 620 to the backpack 600, and the foregoing embodiments are merely illustrative and not intended to be limiting.

With reference to FIG. 6, the shoulder strap 620 may increase in width as it approaches a compression area 624 so that the shoulder strap has more surface area over which to spread the weight of the backpack 600 on the user's shoulder.

Similar to the shoulder strap 120 shown and described above, the shoulder strap 620 may in different embodiments be formed of different materials, may include a cushioning material 629, may be enclosed by an outer shell of material, may include one or more sheaths 625 (for example along the edges of the shoulder strap 620), and so forth. In general, there are many suitable ways of forming the shoulder strap(s) 620, and the foregoing embodiments are merely illustrative and not intended to be limiting.

With reference to FIG. 6, the lower portion of each shoulder strap 620 may be coupled to either a lower portion or side portion of the main body 602. For example, the lower portion of each shoulder strap 620 may be coupled to the main body 602 through an adjustment device 626 (that may include an adjustment strap 627 and a slider mechanism 628), that is similar to the adjustment device 126 described above in connection with FIG. 2. Alternatively, the lower portion of each shoulder strap 620 may be coupled to the main body in a different way.

Each shoulder strap 620 may be supported by a secondary support strap 630 that is coupled to the shoulder strap 620. The secondary support strap 630 may be coupled to the shoulder strap 620 by any suitable coupling method, including, but not limited to, by sewing, bonding, adhering, snapping, thermal welding, and so on. The secondary support strap 630 may also be coupled to the upper portion of the main body 602. The secondary support strap 630 may be coupled to the main body 602 by any suitable coupling method. In other embodiments, the secondary support strap 630 may be defined by the shoulder strap 620, or may be defined by the main body 602. For example, the secondary support strap 630 may be defined by the shoulder strap 620 or the main body 602 if it is an integral part of the shoulder strap 620 or the main body 602 in that the secondary support strap 630 is made from a common piece of material as the shoulder strap 620 or the main body 602.

Figure 7:
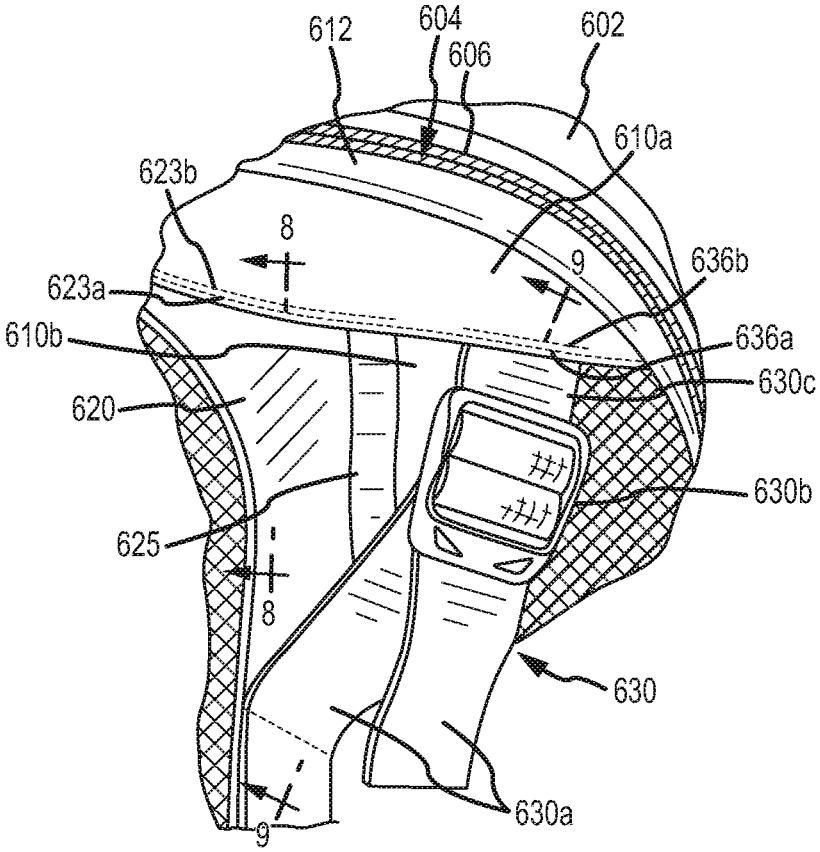
FIG. 7 shows an enlarged view of the right shoulder strap of the backpack shown in FIG. 6 and its secondary support strap.

As mentioned above, each of the secondary support straps 630 may be adjustable. The secondary support straps 630 may be adjustable through an adjustment mechanism 630*b* (e.g., a slider mechanism). For example, with reference to FIGS. 6, 7, and 9, the secondary support strap 630 may include two portions 630*a*, 630*c* that are adjustably coupled through the adjustment mechanism 630*b*. The first portion 630*a* of the secondary support strap 630 may be coupled to the shoulder strap 620, and the second portion 630*b* of the secondary support strap 630 may be coupled to the main body 602 of the backpack. The end of the first portion 630*a* of the secondary support strap 630 that is not coupled to the shoulder strap 620 and the end of the second portion 630*c* that is not coupled to the main body 602 may both, for example, be slidingly received in the adjustment mechanism 630*b*. In this configuration, the secondary support strap 630 may be adjusted by changing the length of the first portion 630*a* of the secondary support strap 630 between the shoulder strap 620 and the adjustment mechanism 630*b*, which may be accomplished by sliding the first portion 630*a* of the secondary support strap 630 through the adjustment mechanism 630*b*.

Figure 10B:
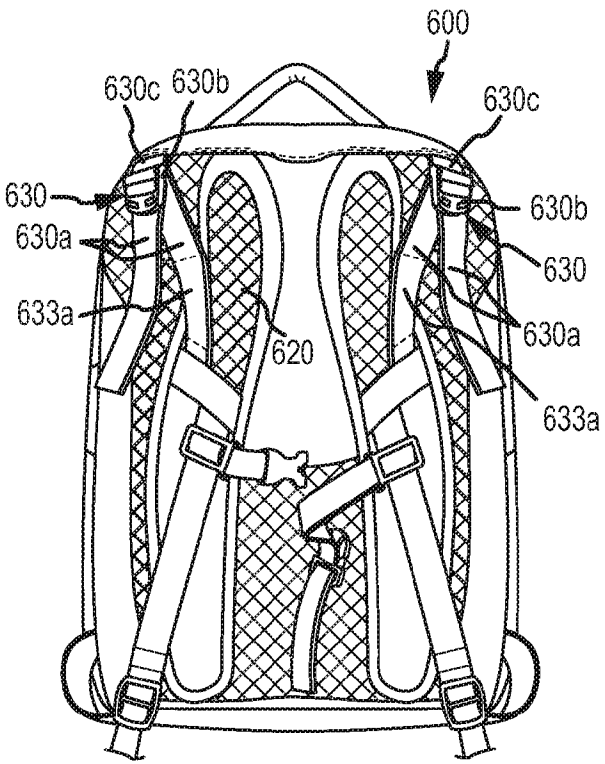
FIG. 10B shows a rear perspective view of the backpack shown in FIG. 6 in a second configuration.
Figure 10A:
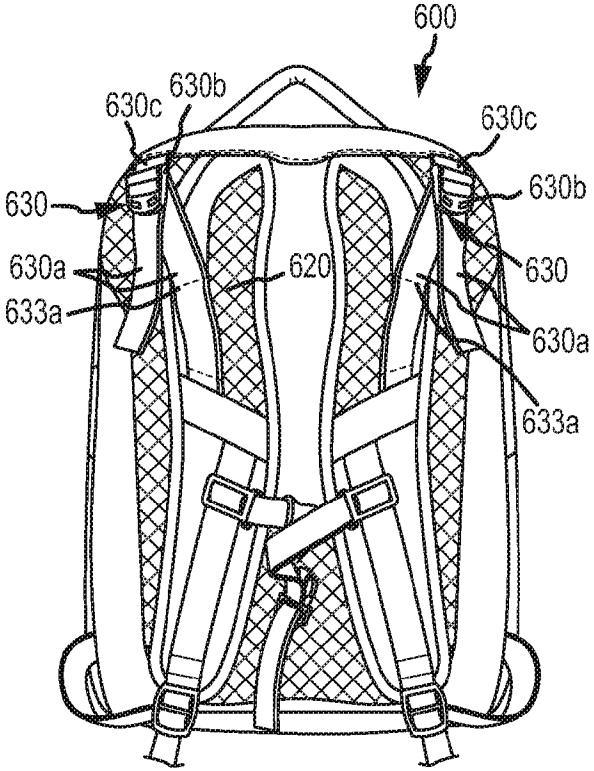
FIG. 10A shows a rear perspective view of the backpack shown in FIG. 6 in a first configuration.

With reference to FIGS. 10A and 10B, adjusting the secondary support strap 630 may change the configuration of the shoulder straps 620 from a first configuration (FIG. 10A) to a second configuration (FIG. 10B). With reference to FIGS. 10A and 10B, the shoulder straps 620 in the first configuration may be relatively straight, whereas the shoulder straps in the second configuration may be at an angle. By changing the configuration of the shoulder straps 620, a user may adjust where along the user's back and shoulders the compression area 624 of each shoulder strap 620 sits.

Figure 9:
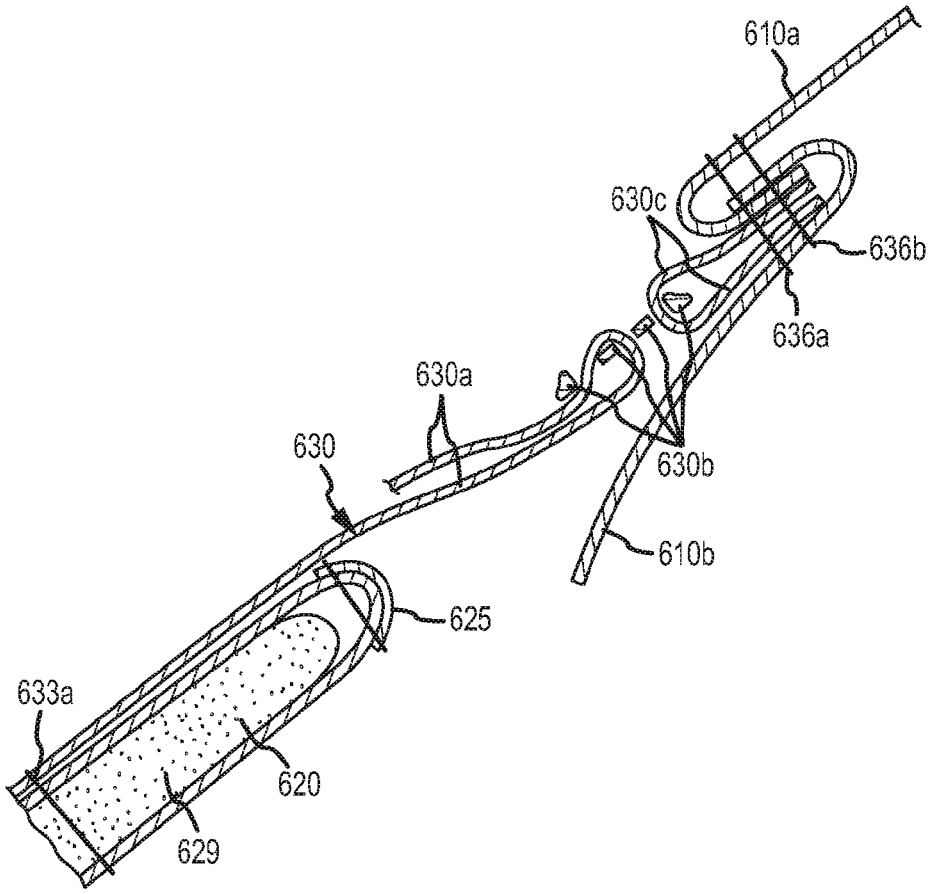
FIG. 9 shows a cross section view of the right shoulder strap of the backpack shown in FIG. 6 and its secondary support strap, viewed along line 9-9 of FIG. 7.

With reference to FIG. 9, the first portion 630*a* of the secondary support strap 630 may be coupled to the shoulder strap 620 through a seam 633*a*. The seam 633*a* may be made, for example, by positioning the first portion 630*a* of the secondary support strap 630 along the shoulder strap 620 and sewing the first portion 630*a* of the secondary support strap 630 to the shoulder strap 620. The second portion 630*c* of the secondary support strap 630 may be coupled to the main body 602 of the backpack 600 similar to how the shoulder strap 620 is coupled to the main body 602 in some embodiments. For example, the second portion 630*c* may be folded over on itself to create a loop, with the adjustment mechanism 630*b* received within the loop. The top portion 610*a* of the rear panel 610 may then be positioned along the looped second portion 630*c* of the secondary support strap 630, and the lower portion 610*b* of the rear panel 610 may be wrapped around the looped second portion 630*c* of the secondary support strap 630 and the top portion 610*a* of the rear panel 610. The upper and lower portions 610*a*, 610*b* of the rear panel 610 may then be coupled along one or more seams 636*a*, 636*b* (one of which may be a reinforcement seam 636*b*). The seams 636*a*, 636*b* may be made, for example, by sewing a stitch, or by another coupled method. In general, there are many suitable ways of coupling the secondary support strap 630 to the shoulder strap 620 and to the main body 602 of the backpack, and the foregoing embodiments are merely illustrative and not intended to be limiting.

As shown in FIGS. 6, 7, 10A, and 10B, the shoulder strap 620 and a secondary support strap 630 may be configured so that they form a "Y" shape. In particular, the lower portion of the shoulder strap 620 forms the base of the "Y", while the upper, tapered portion of the shoulder strap 620 and the secondary support strap 630 form the two diverging branches of the "Y." The "Y" shape may provide several benefits. First, it may allow a relatively large surface area of the shoulder strap 620 (i.e. the compression area 624) to contact a user's shoulders, while reducing the width of the shoulder strap 620 that is coupled to the upper portion of the main body 602. Without the secondary support strap 630, a narrower shoulder strap 620 may decrease the load that can be transferred to the shoulder strap 620 from the main body 602 due to the decreased width of the joint where the shoulder strap 620 is coupled to the main body 602 as compared with a shoulder strap 620 that is not as narrow. The secondary support strap 630, however, may increase the load that can be transferred to the shoulder strap 620 from the main body 602 because the load from the main body 602 is transferred via the secondary support strap 630 in addition to the shoulder strap 620. Another potential advantage of the "Y" shape is that it provides increased breathability near the compression area 624. Furthermore, because the secondary support strap 630 may be adjustable, the configuration of the shoulder strap 620 may be changed relatively quickly and easily. The configuration of the shoulder strap 620 may be changed, for example depending on the size of the shoulders and back of the user. As another example if a user's shoulders tire along a certain portion of the shoulders, the configuration of the shoulder strap 620 may be adjusted so in order to distribute the load along a different part of the user's shoulders.

With reference now to FIG. 1 through 10B, a method of constructing a backpack, such as backpacks 100, 600 shown and described above, may include the act of coupling a backpack shoulder strap to a main body of a backpack. The shoulder strap may include a tapered portion that is coupled proximate where the shoulder strap is coupled to the main body. A secondary support strap may be coupled to the shoulder strap proximate the tapered portion of the shoulder strap. The secondary support strap may also be coupled to the main body of the backpack, which may in some embodiments be proximate an area where the shoulder strap is coupled to the main body. In some embodiments, two shoulder straps and two respective secondary support straps may be included in the backpack. The two shoulder straps may be coupled the main body, and the two secondary support straps may each be coupled to the respective shoulder strap and to the main body by any suitable coupling method, such as sewing, bonding, adhering, snapping, thermal welding, and so on.

The secondary support strap(s) and the shoulder strap(s) may in some embodiments be coupled to an upper portion and a rear panel of the main body of the backpack in some embodiments. Also, the shoulder strap and/or one or more of the seams may be covered with a sheath in order to, for example, protect or hide the edges of different panels or elements.

A variety of embodiments and variations of structures and methods are disclosed herein. Where appropriate, common reference numbers and words were used for common structural and method features. However, unique reference numbers and words were sometimes used for similar or the same structural or method elements for descriptive purposes. As such, the use of common or different reference numbers or words for similar or the same structural or method elements is not intended to imply a similarity or difference beyond that described herein.

References to "top," "bottom," "side," "front," "back", "lower," and "upper," as well as any other relative positional or directional descriptor are given by way of example to aid the reader's understanding of the particular embodiment(s) described. They should not be read to be requirements or limitations, particularly as to the position, orientation, or use of the invention unless specifically set forth in the claims. Connection references (e.g. attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims. In some instances, components are described with reference to "ends" having a particular characteristic or being connected with another part. Those skilled in the art will recognize that the disclosed embodiments are not limited to components which terminate immediately beyond their points of connection with other parts.

The apparatus and associated method in accordance with the present invention has been described with reference to particular embodiments thereof. Therefore, the above description is by way of illustration and not by way of limitation. Accordingly, it is intended that all such alterations, variations, and modifications of the embodiments are within the scope of the present invention as defined by the appended claims. In methodologies directly or indirectly set forth herein, various steps and operations are described in one possible order of operation, but those skilled in the art will recognize that steps and operations may be rearranged, replaced, or eliminated without necessarily departing from the spirit and scope of the disclosed embodiments.

For example, with reference to FIGS. 4, 5, 8, and 9 various coupling techniques have been shown and described, but the shoulder straps and secondary support straps may be coupled to each other and to the backpack in any suitable manner, and are not limited to being coupled as shown in these Figures. As another example, sheaths have been described above, and they may or may not be used in different embodiments. As still another example, the backpacks 100, 600 have been described as having a single secondary support strap for each shoulder strap; however, each shoulder strap may have two secondary support straps in some embodiments.

What is claimed is:

1. An apparatus for carrying items, comprising:

a main body having a front panel, a rear panel, and opposing side panels, the main body defining a main compartment that may be accessed by a sealing mechanism;

a shoulder strap coupled to at least an upper portion of the rear panel and coupled to at least a lower portion of the rear panel, the lower portion distal the upper portion; and a secondary support strap coupled to the shoulder strap and to at least the upper portion of the rear panel, the secondary support strap coupled to the upper portion of the rear panel at a position laterally spaced apart from the shoulder strap.

2. The apparatus of claim 1, wherein the shoulder strap is tapered proximate the upper portion of the rear panel.

3. The apparatus of claim 2, wherein the shoulder strap and the secondary support strap define a "Y" shape as viewed from a back side of the apparatus.

4. The apparatus of claim 3, wherein a first end portion of the secondary support strap is sewn to the shoulder strap and a second end portion is sewn to the rear panel.

5. The apparatus of claim 3, wherein the rear panel of the apparatus is for abutting the back of a user when the apparatus is in use.

6. The apparatus of claim 1, wherein a first end portion of the secondary support strap is sewn to the shoulder strap and a second end portion is sewn to the rear panel.

7. The apparatus of claim 1, wherein the apparatus includes at least one compression mechanism.

8. The apparatus of claim 7, wherein the at least one compression mechanism comprises:

a first strap coupled to the main body and terminating in a first buckle element; and a second strap coupled to the main body and terminating in a second buckle element that may be selectively operatively associated with the first buckle element.

9. The apparatus of claim 1, wherein the upper portion is a portion for abutting a user's shoulders when the apparatus is in use, and the lower portion is a portion for abutting a user's lower back when the apparatus is in use.

10. The apparatus of claim 1, wherein the secondary support strap is adjustable.

11. The apparatus of claim 10, wherein the secondary support strap comprises a first portion and a second portion, and the secondary support strap is configured to be adjusted by sliding the first portion of the secondary support strap through a slider mechanism.

12. The apparatus of claim 10, wherein a configuration of the shoulder strap changes when the shoulder strap is adjusted.

13. The apparatus of claim 1, wherein the secondary support strap is coupled to a sheath of the shoulder strap.

14. A method for constructing a backpack, comprising:

coupling a shoulder strap to at least an upper portion of a rear panel of a main body of a backpack and to at least a lower portion of the rear panel, the main body having a front side with a main compartment, the upper portion distal the lower portion, the shoulder strap including a tapered portion proximate an area of the shoulder strap where the shoulder strap is coupled to the main body;

coupling a secondary support strap proximate the tapered portion of the shoulder strap, the secondary support strap extending laterally from the shoulder strap; and coupling the secondary support strap to at least the upper portion of the rear panel at a position laterally spaced apart from the shoulder strap.

15. The method of claim 14, wherein the secondary support strap is coupled to the shoulder strap by sewing the secondary support strap to the shoulder strap.

16. The method of claim 14, wherein the secondary support strap is coupled to at least the upper portion of the rear panel of the main body of the backpack by sewing together the upper portion, the secondary support strap, and the rear panel.

17. The method of claim 14, wherein the shoulder strap is partially covered by a sheath proximate the area of the shoulder strap where the shoulder strap is coupled to the main body.

18. The method of claim 17, wherein the shoulder strap comprises an outer shell and a cushioning material.

19. The method of claim 14, wherein the shoulder strap is a first shoulder strap, the tapered portion is a first tapered portion, and the secondary support strap is a first secondary support strap, further comprising:

coupling a second shoulder strap to at least the upper portion of the rear panel of the backpack and to at least the lower portion of the rear panel, the second shoulder strap including a second tapered portion;

coupling a second secondary support strap proximate the second tapered portion of the second shoulder strap, the second secondary support strap extending laterally from the second shoulder strap; and coupling the second secondary support strap to at least the upper portion of the rear panel of the backpack at a position laterally spaced from the shoulder strap.

20. The method of claim 14, wherein the secondary support strap is coupled to the main body of the backpack proximate an area where the shoulder strap is coupled to the main body.

21. The method of claim 14, wherein the secondary support strap distributes at least a portion of the weight of the apparatus in a lateral direction with respect to the shoulder strap.

22. The method of claim 14, wherein the secondary support strap increases the surface area of weight distribution in a direction lateral to the shoulder strap.

23. The method of claim 14, wherein the secondary support strap distributes the weight of the apparatus to at least the shoulder strap and the secondary support strap.

24. A backpack, comprising:

a main body having a front panel, a rear panel, and opposing side panels, wherein the main body defines a main compartment configured to carry an object, the object having a weight;

a shoulder strap coupled to at least an upper portion of the rear panel and also coupled to at least a lower portion of the rear panel, the upper and lower portions separated distally along the rear panel of the main body, the shoulder strap configured to bear a first portion of the weight of the object when the backpack is in use; and a secondary support strap coupled to at least the rear panel of the main body proximate the upper portion and at a position laterally spaced apart from the shoulder strap, the secondary support strap further coupled to the shoulder strap and extending therefrom, the secondary support strap configured to transfer a second portion of the weight of the object to the shoulder strap when the backpack is in use, so that the shoulder strap bears both the first and the second portions of the weight of the object.

25. The apparatus of claim 1, wherein the secondary support strap distributes at least a portion of the weight of the apparatus in a lateral direction with respect to the shoulder strap.

26. The apparatus of claim 1, wherein the secondary support strap increases the surface area of weight distribution in a direction lateral to the shoulder strap.

27. The apparatus of claim 1, wherein the secondary support strap distributes the weight of the apparatus to at least the shoulder strap and the secondary support strap.

* * * * *